United States Patent [19]

Frank et al.

[11] 4,077,620

[45] Mar. 7, 1978

[54] APPARATUS FOR THE SUCCESSIVE RELEASE OF ITEMS OF MAIL FROM A STACK

[75] Inventors: Werner Frank, Reichenau; Henning Jeschke, Konstanz; Gisbert Burkhardt, Reichenau, all of Germany

[73] Assignee: Licentia Patent-Verwaltungs-GmbH, Frankfurt am Main, Germany

[21] Appl. No.: 781,467

[22] Filed: Mar. 25, 1977

[30] Foreign Application Priority Data

| | | |
|---|---|---|
| Mar. 27, 1976 | Germany | 2613261 |
| Mar. 24, 1977 | Germany | 2712907 |

[51] Int. Cl.[2] ..... B65H 7/02

[52] U.S. Cl. ..... 271/10; 271/259; 271/265

[58] Field of Search ..... 271/10, 258, 259, 265

[56] References Cited

U.S. PATENT DOCUMENTS

| | | | |
|---|---|---|---|
| 3,204,950 | 9/1965 | Hanchett | 271/259 |
| 3,264,630 | 8/1966 | Conklin | 271/259 X |
| 3,490,687 | 1/1970 | Bowman | 271/259 X |
| 3,981,493 | 9/1976 | Klappenecker | 271/259 X |
| 3,988,017 | 10/1976 | Kyhl | 271/259 X |
| 4,030,722 | 6/1977 | Irvine | 271/259 X |
| 4,030,723 | 6/1977 | Irvine | 271/259 X |

FOREIGN PATENT DOCUMENTS

| | | | |
|---|---|---|---|
| 2,410,145 | 9/1975 | Germany | 271/259 |
| 2,202,087 | 9/1972 | Germany | 271/259 |

*Primary Examiner*—Richard A. Schacher
*Attorney, Agent, or Firm*—Spencer & Kaye

[57] ABSTRACT

In apparatus for the successive discharge and conveyance, along a conveying path, of items of mail from a stack by a continuously driven conveying device and an externally controllable removal member arranged to transport successive items from the stack to the region of action of the conveying device, the desired spacing between successive items is established by the provision of a first sensing unit disposed between the stack and the conveying device to define a first measuring path extending along the conveying path and to provide an output signal indicative of the length of the portion of the first measuring path traversed by the leading edge of an item presently being conveyed by the removal device, a second sensing unit disposed downstream of the first sensing unit, along the conveying path, to define a second measuring path offset from the first measuring path, along the conveying path, by a distance corresponding to the desired spacing between successive items, and to provide an output signal indicative of the length of the portion of the second measuring path traversed by the leading edge or trailing edge of an item being conveyed by the conveying device, and a control member connected to place the removal device into operation upon production of output signals indicating that the length of the portion of the second measuring path traversed by the leading or trailing edge of an item is equal to the length of the portion of the first measuring path traversed by the leading edge of the immediately following item.

14 Claims, 8 Drawing Figures

APPARATUS FOR THE SUCCESSIVE RELEASE OF ITEMS OF MAIL FROM A STACK

BACKGROUND OF THE INVENTION

The present invention relates to apparatus for the successive release of separated items of mail from a stack. Apparatus of this type generally includes a removal member which is continuously in engagement with the foremost item while circulating under controlled conditions so as to advance successive items into the effective range of a pair of permanently driven conveying rollers, a first sensing device disposed between the stack outlet and the conveying rollers, a second sensing device spaced from the first device, and a control circuit which controls the drive of the removal member in dependence on the signals from the sensor devices so that the next item follows the trailing or leading edge, constituting a reference edge, of the previously separated item with a spacing which corresponds to the spacing between the sensing devices.

Separating devices of this type are disclosed, for example, in German Offenlegungsschrift [Laid-Open Application] No. 24 10 145. In that apparatus, a sensing member, such as in particular a single light barrier, is disposed between the stack output and the conveying rollers and the position of this sensing member defines a uniform waiting position for all items.

The control circuit is designed so that the drive of the removal member is switched on only if either the sensing member is enabled or the sensing member is blocked and a call signal is present at the control circuit, and the braking time upon stoppage of the removal member and the distance between the sensing member and the conveying rollers are selected so that the removal member pushes each item up to the sensing member and, only after receiving a call signal, pushes it on to the effective range of the conveying rollers. The call signal which is given to the control circuit is the output signal from a second sensing member which follows after the conveying rollers and which is actuated by the passage of the respective reference edge of the previously discharged item.

Accordingly, in the known devices each item to be separated is accelerated twice by the removal member: once during the advancement to the waiting position at the first sensing member and a second time during the advancement from the waiting position into the effective range of the continuously driven conveying rollers. This requires a correspondingly frequent actuation of the drive for the removal member or for the brake coupling, respectively, which is utilized to control it.

SUMMARY OF THE INVENTION

It is an object of the present invention to provide a separating device of the above mentioned type in which each item to be separated is generally accelerated but once.

This and other objects according to the invention are achieved by the provision of a novel sensing and control system in apparatus for the successive discharge and conveyance, along a conveying path, of separated items of mail from a stack of such items, which apparatus includes means defining a stack region for containing such stack of items and presenting a stack outlet for the discharge of items from one end of the stack, continuously driven conveying means spaced from the stack outlet and defining a portion of the conveying path, the conveying means having an effective range and conveying each item entering the effective range along such portion of the conveying path, removal means disposed between the stack region and the conveying means to define an initial portion of the conveying path and controllably operable for conveying successive items from the one end of the stack, through the stack outlet, along the initial portion of the conveying path and into the effective range of the conveying means, with a first edge of each item constituting a leading edge and a second edge of each item constituting a trailing edge, first item sensing means disposed for sensing the presence of an item on the conveying path at a location between the stack outlet and the conveying means, second item sensing means disposed for sensing the presence of an item on the conveying path at a location spaced from, and downstream of, the location associated with the first sensing means, and control means connected to respond to output signals from the sensing means and connected to control the operation of the removal means for causing the removal means to establish a desired spacing, along the conveying path, between one of the first and second edges of each item and the immediately following item which corresponds to the spacing between the first and second sensing means. In accordance with the present invention, each of the sensing means is arranged for monitoring an item along an associated measuring path along the conveying path, the measuring path of the first sensing means extending from the stack outlet and the measuring path of the second sensing means being offset from the measuring path of the first sensing means by a distance corresponding to the desired spacing, the first sensing means includes means for producing an output signal representative of the distance which has been traversed by the leading edge of an item along the measuring path of the first sensing means, the second sensing means includes means for producing an output signal representative of the distance which has been traversed by the one of the first and second edges of an item along the measuring path of the second measuring means, and the control means is arranged for responding to the output signals produced by the producing means for causing the removal means to begin conveying an item present on the initial portion of the conveying path upon production of output signals indicating that the distance traversed by the one of the edges of an item along the measuring path of the second sensing means is equal to the distance traversed by the leading edge of the immediately following item along the measuring path of the first sensing means.

DESCRIPTION OF THE PREFERRED EMBODIMENTS

Figure 1:
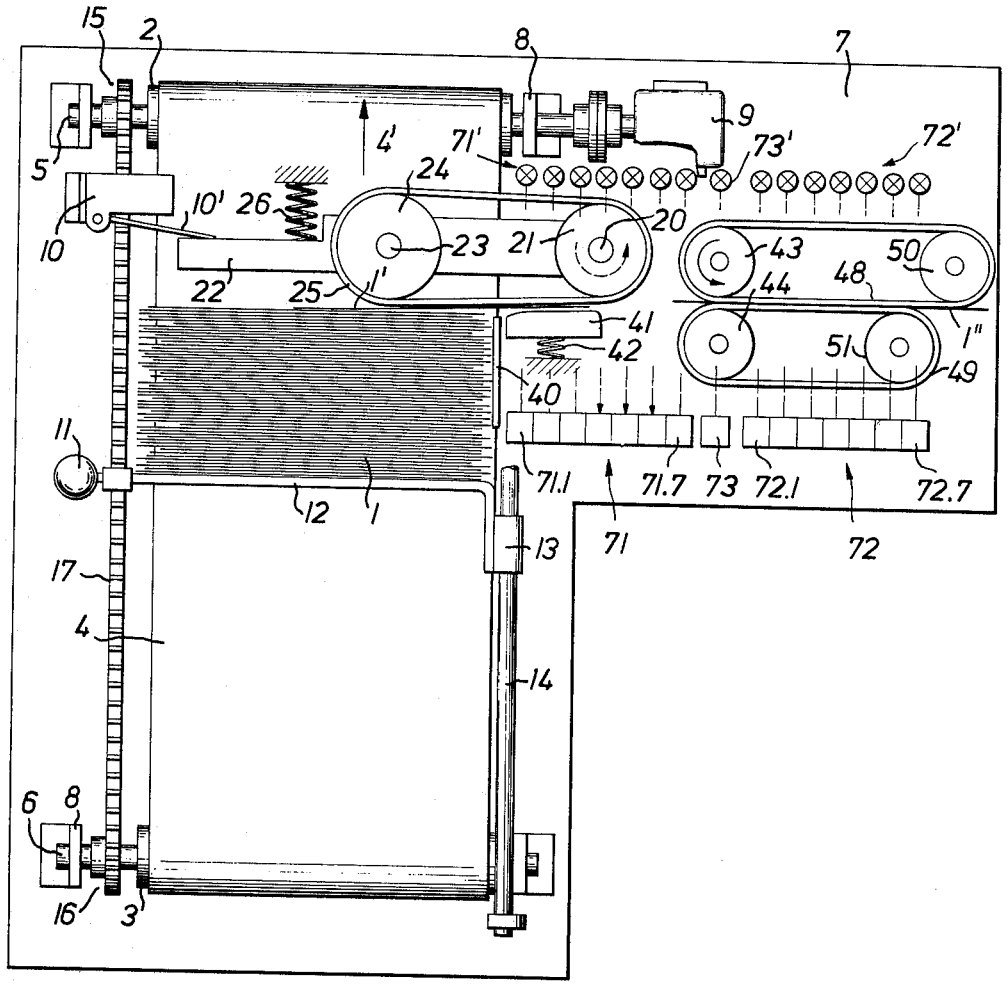
FIG. 1 is a partially simplified top plan view of a first embodiment of a separating device according to the invention.

FIG. 1 shows apparatus containing a stack 1 of items, the stack being supported by an underfloor belt 4 which is guided around rollers 2 and 3 having respective axles 5 and 6. The bearings for these axles are provided in block 8 which are fastened to the base plate 7 of the apparatus. Axle 5 is coupled to a drive motor 9 which is controlled, in a manner to be described in detail below, by a microswitch 10 fastened to the base plate and having an actuating arm 10', so as to drive the underfloor belt 4 in the direction of arrows 4' when required.

The rear end of stack 1 is supported by a supporting wall 12 which is provided with a handle 11 and which is mounted on a rod 14 by means of a sleeve 13 permitting wall 12 to pivot about the axis of rod 14 and to be displaceable in a direction parallel to the underfloor belt 4. A chain 17, runs over chain wheels 15 and 16, respectively, mounted on axles 5 and 6. Wall 12 is provided with a downwardly extending tongue, not visible in FIG. 1, which engages in chain 17 to cause the supporting wall 12 to move in unison with the chain. If further items are to be added to the stack, the supporting wall 12 can be displaced relative to the chain by lifting handle 11 so that the connection with chain 17 is released.

A shaft 20 is mounted in base plate 7 to be freely rotatable about a vertical axis and a roller 21 is fastened to shaft 20. Shaft 20 also serves as a pivotal mount for a rocker 22 which supports the axle of a removal roller 24. A removal belt 25 is guided around rollers 21 and 24 to serve as the item separating member. The outer surface of belt 25 is made to have a high coefficient of friction with the items to be separated.

The rocker 22 is supported against base plate 7 by a spring 26 which is indicated schematically in FIG. 1 so that the position of rocker 22 depends on the contact pressure exerted by stack 1. The free end of the rocker acts on the actuating arm 10' of microswitch 10. If the contact pressure exerted on arm 22 by the stack is too low, a rest contact of the microswitch closes so that the drive motor 9 is switched on to drive the underfloor belt 4 and, via chain 17, the supporting wall 12 in the direction toward removal roller 24 until, after the rocker has reached the position which corresponds to the intended contact pressure, the above-mentioned rest contact opens.

Figure 2:
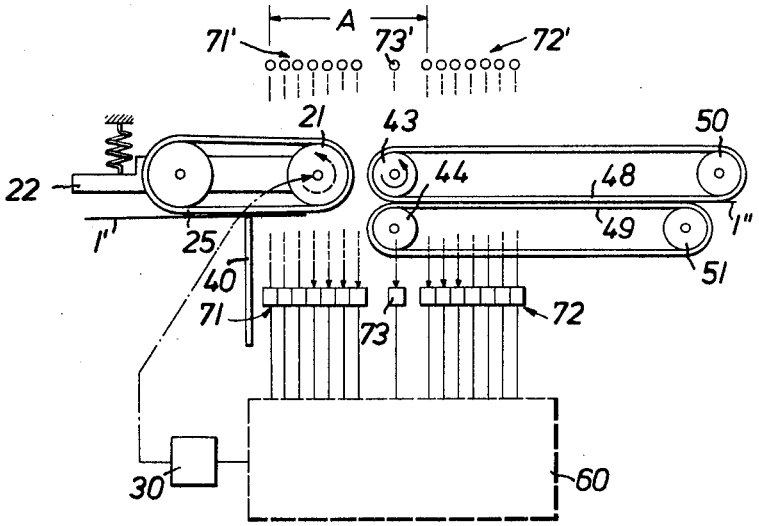
FIG. 2 is a schematic top plan view circuit of an embodiment corresponding to that shown in FIG. 1.

As is shown in FIG. 2, shaft 20 is driven in the direction of the broken line arrow via a brake coupling 30 by a motor which is not shown in the drawings and which runs continuously during operation, i.e. shaft 20 is driven intermittently. The brake coupling is designed in a known manner so that shaft 20 is connected with the drive when a control signal is present from a control circuit 60 and is braked so as to sever this connection when the control signal is absent.

As can be seen in both FIGS. 1 and 2, the leading edges of the items in stack 1, pointing in the conveying direction, are restrained by an abutment wall 40, the abutment wall being positioned to leave a gap, or stack outlet, between itself and belt 25 to permit removal of the items by the removal belt.

Opposite roller 21, a retaining device is provided in the conveying path, this retaining device being shown only schematically in FIG. 1 as a stripper 41 which is pressed by a spring 42 against the removal belt 25 or against the items 1' being carried along by the removal belt 25. The stripper is assumed to be mounted by means of components, which are not illustrated, which cause it to be movable approximately perpendicularly to the conveying direction. The stripper surface facing the items is made, in a known manner, so that its coefficient of friction with the items is less than that of the removal belt 25.

A pair of continuously driven conveying rollers 43 and 44 is disposed in the path of movement of the items and these rollers positively carry the items along as soon as they have reached the effective range of the rollers. These conveying rollers here also serve as guide rollers of conveyor belts 48 and 49 which are guided about further guide rollers 50 and 51, respectively, on their conveying path. While driven conveying roller 43 is mounted on an axle supported on base plate 7, conveying roller 44 could be mounted in a known manner to be yielding, for example on a pivotal lever, which for the sake of simplicity is not shown in the drawing.

A first measuring path 71 is disposed downstream of the stack outlet, i.e. downstream of abutment wall 40, along the conveying path for the items, and a second measuring path 72 is provided at a location further downstream along the conveying path, spaced in the conveying direction from path 71 by the distance A shown in FIG. 2. These measuring paths are designed, according to the invention, so that their output signals are a measure for the portion of the measuring path along which the leading edge of the item 1' being discharged or the reference edge of the previously discharged item 1'', respectively, has passed.

In the first embodiment shown in FIGS. 1 and 2, each of the measuring paths 71 and 72 is formed by a group of seven successive light barriers which include light receivers 71.1 to 71.7 or 72.1 to 72.7, respectively, and associated light sources 71' and 72', respectively. Rows of diodes can be used with advantage as the light receivers.

This embodiment further includes a light barrier 73 and associated light source 73' for monitoring the effective range of conveying rollers 43 and 44 and the second measuring path 72 is disposed downstream of this effective range. The items are to be discharged onto the conveying path with uniform spacing, i.e. with a uniform distance A between the leading edge of the item 1' to be discharged and the trailing edge of the previously discharged item 1''.

The present invention is based on the observation that in the known separating device of the above-mentioned type, during advancement of an item from the stack into the waiting position and again into the effective range of the continuously driven conveying rollers, generally one further item is pulled out of the stack and is then left somewhere in the region of the retaining device. The present invention makes it possible to advance each item 1' to be discharged directly from this intermediate, somewhat undefined, position into the effective range of the continuously driven conveying rollers 43 and 44 so that it enters the conveying path at a predetermined distance from the reference edge of the previously discharged item 1''.

This is made possible essentially by the use of the above-described measuring paths 71 and 72 and by suitable design of control circuit 60.

According to the present invention, control circuit 60 is constructed to cause removal belt 25 to begin to be driven as soon as the length of the portion of the second measuring path 72 traversed by the trailing edge of the previously discharged item 1" has become equal to the length of the portion of the first measuring path over which the item 1' protrudes- for the reasons explained above.

Figure 3:
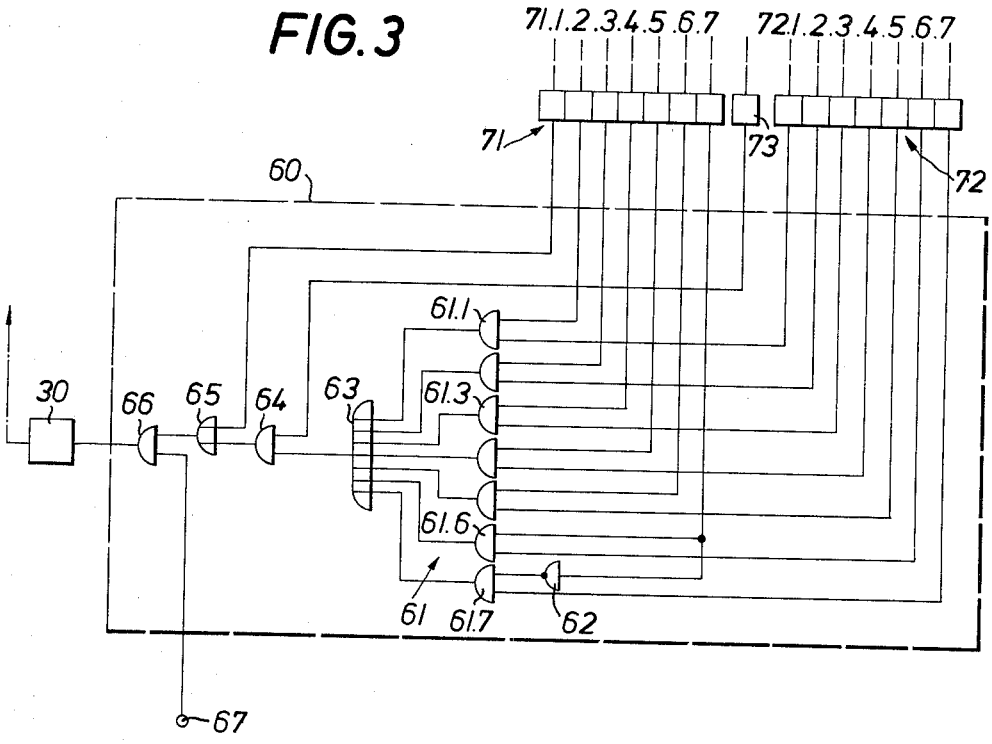
FIG. 3 is a circuit diagram of one form of control circuit for the embodiments of FIGS. 1 and 2.

One embodiment of such a control circuit is shown in FIG. 3 and is arranged to compare the paths traversed by the above-mentioned edges of successive items by logic linkage of the output signals of the corresponding light barriers of the two measuring paths 71 and 72. For this purpose, seven AND members 61.1 . . . 61.3 . . . 61.6, 61.7, an inverter 62 and an OR member 63 are provided.

Light barriers 71.1 to 71.7, 72.1 to 72.7 and 73 each emit a logic "1" as their output signal if they are unobstructed and a logic "0" if they are obstructed. One input of each of AND members 61.1 to 61.6 is connected to a respective one of light barriers 71.2 to 71.7, while the other input of each AND member is connected to a corresponding respective one of light barriers 72.1 to 72.6. One input of the last AND member 61.7 is connected, via inverting member 62, to light barrier 71.7 and the other input of member 61.7 is connected directly with the light barrier 72.7. The outputs of AND members 61 are combined by OR member 63. A further AND member 64 emits a logic "1" if at least one of the AND members 61 and the light barrier 73 simultaneously emit a "1". An OR member 65 emits a "1" if a "1" is emitted by AND member 64 or by light barrier 71.1. This "1" travels through an AND member 66, and a power amplifier (not shown), as a control signal to brake coupling 30 as long as the second input of AND member 66 is enabled by a gating, or "operation" signal applied to terminal 67. The removal belt 25 is then driven via rollers 21 and 24 whenever this control signal is present.

Thus the separator of FIGS. 1 to 3 operates as follows:

Let it be assumed that a first item 1" advanced by removal belt 25 has just reached the effective range of the continuously driven conveying rollers 43 and 44 and has covered light barrier 73, whereupon the output signal from AND member 64 goes to "0" so that brake coupling 30 becomes deactuated and the drive of the removal belt 25 is stopped. Conveying rollers 43 and 44 now pull item 1" out of the range of the stopped removal belt 25 while a further item 1' which had been taken from stack 1 together with item 1" is retained, with the cooperation of stripper 41 (not shown in FIGS. 2 and 4) in the position shown in FIGS. 1, 2 and 4; i.e. such that it protrudes into the first measuring path 71 to a point beyond light barrier 71.3.

With the advancing of item 1" on conveying path 48, 49, the trailing edge of this item successively releases, or uncovers, the light barriers 71.4 to 71.7 of the first measuring path 71 which are not obstructed, or covered, by item 1", light barrier 73 and light barriers 72.1 to 72.7. When light barrier 72.3 becomes unobstructed, the distance traversed by the trailing edge of item 1" along the second measuring path 72 has become equal to the distance by which item 1' extends into the first measuring path 71, i.e. the leading edge of item 1' is a distance A behind the trailing edge of item 1". At this moment, one of the AND members 61, in this case member 61.3, emits a "1" output signal for the first time.

As a result, a control signal reaches brake coupling 30 via OR member 63, AND member 64 which was previously enabled due to the unblocking of light barrier 73, and members 65 and 66. The drive for removal belt 25 then starts again and item 1' to be discharged is now advanced into the effective range of conveying rollers 43 and 44. As soon as its leading edge obstructs light barrier 73, the above-assumed starting state has again been reached and the further operation is repeated accordingly as long as the "operation" signal is present at terminal 67.

If, during the removal of an item 1", an item 1' is carried along to extend into measuring path 71 beyond light barrier 71.7 so as to block that barrier, then inverter 62 supplies a "1" signal to its respective input AND member 61.7 so that when light barrier 72.7 subsequently becomes unobstructed, AND member 61.7 emits a "1" signal.

It may now happen that during removal of a first item 1" no other item 1' happens to be carried along from stack 1 to protrude into the first measuring path 71. According to a further embodiment of the invention, the control circuit 60 is then constructed so that the removal belt 25 is additionally driven if the above-described condition exists, and as long as it is evident from the output signal of the first measuring path 71 that the condition continues to exist. In the embodiment of FIG. 3, this is accomplished in a simple manner by connecting the output of light barrier 71.1 directly to OR member 65 so that the latter emits a "1" independently of the state of all other light barriers if, and as long as, light barrier 71.1 is unobstructed.

If measuring paths 71 and 72 are formed, as in FIGS. 1 and 2, by successive light barriers or similar sensing members, the control circuit could also be designed so that the comparison of the two partial paths is effected by a comparison of the number of light barriers traversed in the first measuring path with the number of light barriers traversed in the second measuring path; i.e. by digitally measuring the partial paths with the aid of counting procedures. Finally, the evaluation could also be effected in such a manner, for example, that the output signals of the light barriers 71.1 to 71.7 and 72.1 to 72.7 of both measuring paths 71 and 72 are algebraically added and the resulting voltage values which have been quantized with respect to the partial paths are compared with one another.

Figure 4:
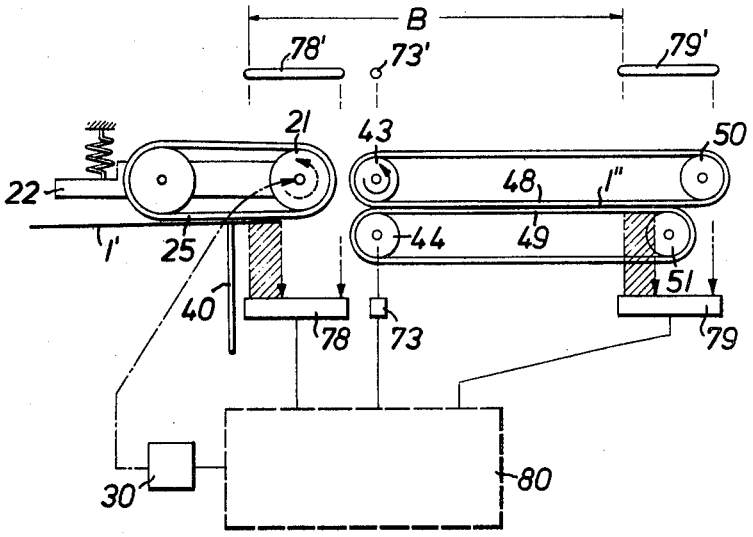
FIG. 4 is a view similar to that of FIG. 2 of a second embodiment of a separating device according to the invention.

The embodiment shown in FIG. 4 differs from that of FIGS. 1 to 3 initially in that in this case each item to be discharged from the stack output is to reach the conveying path at a predetermined distance B from the leading edge, rather than trailing edge, of the previously discharged item. Consequently, the corresponding portions of measuring paths 78 and 79 are spaced apart by this distance B.

Furthermore, while in the embodiment of FIGS. 1 to 3 the two partial path lengths traversed along the two measuring paths are each monitored by a plurality of successive sensing members, this is not the case in the embodiment of FIG. 4. Here, each of measuring paths 78 and 79 is formed by a respective single sensing member whose output signal amplitude is a measure of the respective partial path length to be compared. These sensing members may be, in particular, photoelectric receivers which are illuminated by light sources 78' and 79' and whose output signal values are a function of the remaining illuminated surface, which depends on the length of the partial path obstructed by the respective items.

The control circuit 80 for the separator of FIG. 4 is thus designed so that it emits a control signal to excite the brake coupling 30 as soon as the amplitude value of the output signal from measuring path 79 has become just as small as that of the output signal from measuring path 78. The mode of operation of this embodiment otherwise corresponds to that of the embodiment of FIGS. 1 through 3.

Figure 8:
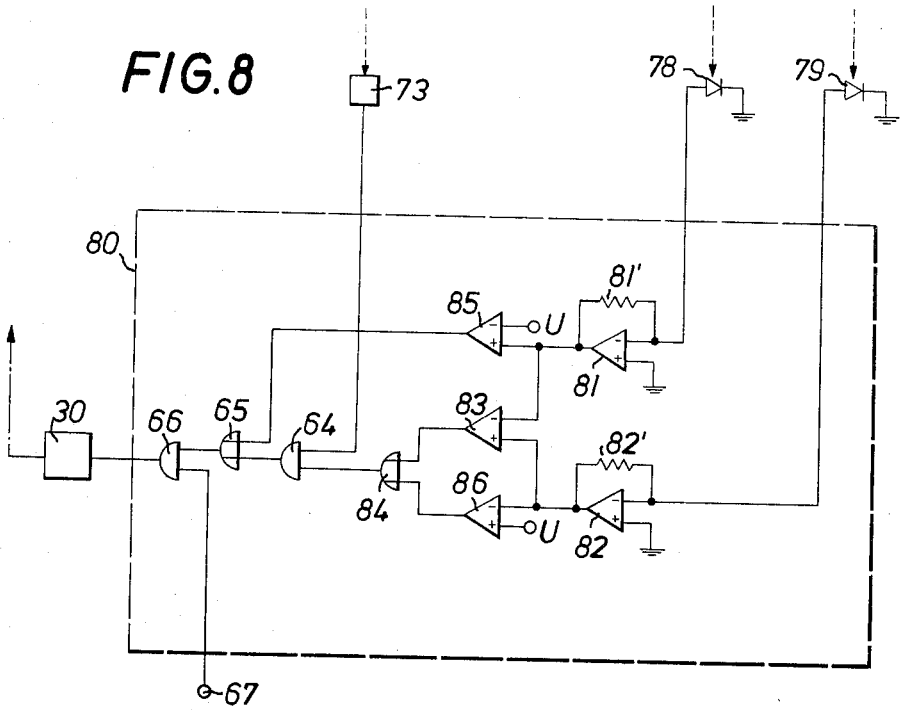
FIG. 8 is a circuit diagram of one form of control circuit for the embodiment of FIG. 4.

One embodiment of a control circuit 80 is shown in FIG. 8. Both photoelectric receivers, constituting the measuring paths, are photo diodes 78 and 79 and are connected to the input circuit of an amplifier 81 and 82 respectively. Each amplifier has a feedback resistor 81' and 82' respectively and is designed so that its output voltage is proportional to the quantity of light which falls on to the attached diode. The outputs of amplifiers 81 and 82 are connected to a comparator 83 which emits a "1" output signal whenever the output voltage of amplifier 82 equals or falls below the output voltage of amplifier 81. This is true whenever the distance traversed by the leading edge of items 1'' along the second measuring path, diode 79, has become equal to the distance by which item 1' extends into the first measuring path, diode 78. Said "1" output signal via OR member 84 reaches AND member 64 whereupon the further operation is like that described in connection with the embodiment of FIGS. 2 and 3.

Further the outputs of amplifiers 81 and 82 are connected to one input of a comparator 85 and 86 respectively. The second input of each comparator is connected to a reference potential U which is rated so that comparator 85 emit an output signal, if its associated diode 78 is fully lighted; i.e. when no item is present in the measuring path concerned, and comparator 86 emits an output signal if diode 79 is fully darkened by an item present in its respective measuring path. The output of comparator 85 is connected to an input of OR member 65 and the output of comparator 86 to an input of OR member 84. Thereby, in addition to the normal operation, a control signal is put on to brake coupling 30 in order to start the drive for removal belt 25 whenever no item is present in the first measuring path, diode 78, or whenever diode 79 of the second measuring path is fully darkened by an item passing therethrough.

Figure 5:
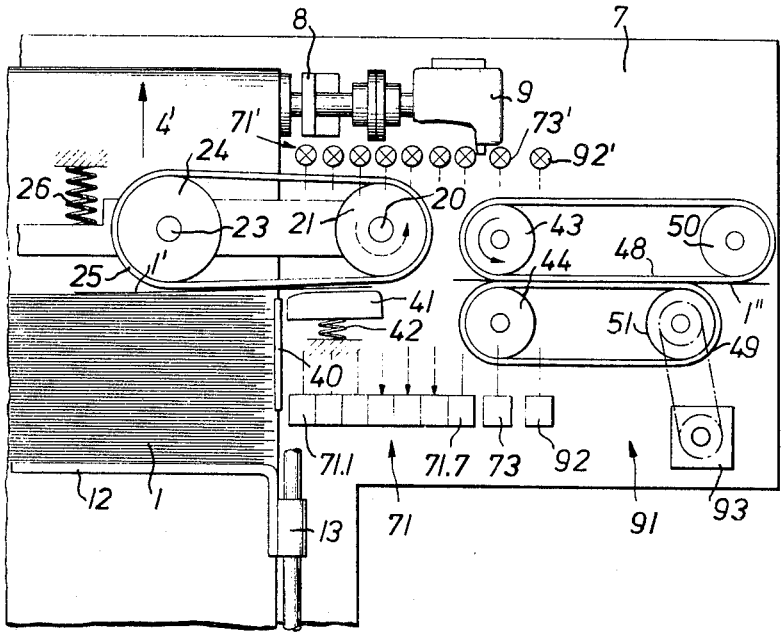
FIG. 5 is a partial top plan view of a third embodiment of a separating device according to the invention.
Figure 6:
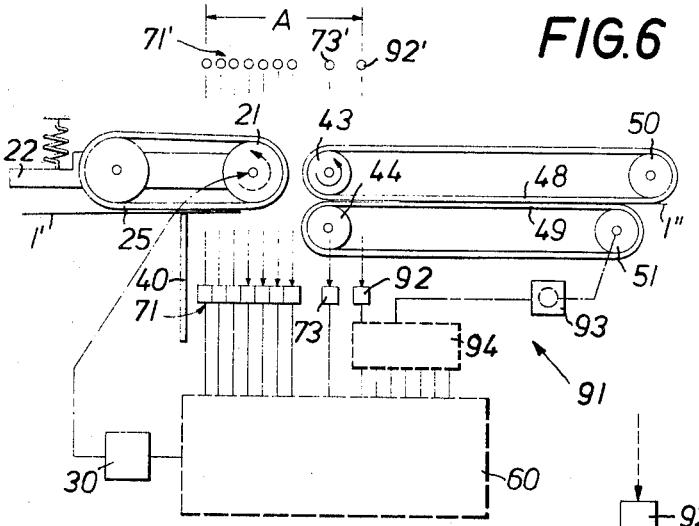
FIG. 6 is a view similar to that of FIG. 2 of an embodiment according to FIG. 5.
Figure 7:
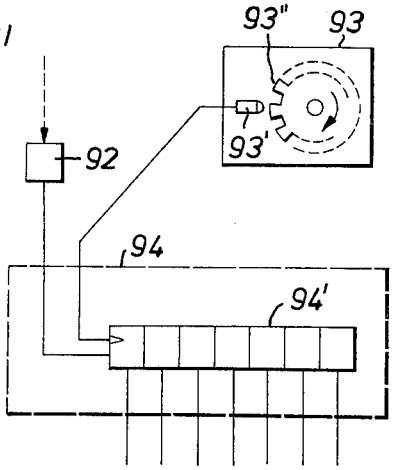
FIG. 7 is a schematic view of the components belonging to the second measuring path of the embodiment of FIG. 6.

FIGS. 5, 6 and 7 relate to a third embodiment of the invention which differs from that shown in FIGS. 1 and 2 only by having a differently constructed second measuring path. Therefore in FIG. 5 only that part of the apparatus is represented which shows the modification. To the second measuring path 91 of the third embodiment belongs a sensing member which is a light barrier 92, a pulse generator 93 and a storage device 94, said light barrier being positioned at the input end of that measuring path.

Light barrier 92 emits a logic "1" as its output signal if it is unobstructed and a logic "0" if it is obstructed. Its position along the conveying path is comparable to that of light barrier 72.1 in FIG. 1.

Pulse generator 93 is coupled to the continuously driven conveying means and is constructed so that it emits a series of pulses the frequency of which is proportional to the conveying speed of the conveyor belts 48 and 49 which is the conveying speed within the second measuring path 91. Pulse generator 93 for instance may comprise, as shown in FIG. 7, a toothed disc 93'' which is scanned by a sensor 91' and is driven via an appropriate linkage by the guide roller 51.

Storage device 94 is designed so that it simulates, in dependancy on the signals from light barrier 92 and from pulse generator 93, the passage of each item along the second measuring path 91. In the embodiment shown in FIG. 7 the storage device contains a shifting register 94', the signal input of which is connected to the light barrier 92 and the clock input is connected to the pulse generator 93, whereas the parallel-outputs are linked to the control circuit 60 as shown in FIGS. 6 and 3.

In the embodiment according to FIGS. 5 to 7 the frequency of the clock pulses emitted by pulse generator 93 is related to the conveying speed along the second measuring path 91 so that the intervals of the pulses correspond to the intervals of the successive activations of the light barriers 72.1 to 72.7 by the first and second edges of an item passing the measuring path 72 in the embodiment of FIG. 1. It is evident, therefore, that the signals appearing at the parallel-outputs of the shifting register 94' of measuring path 91 correspond, in the same circumstances, to the signals emitted by the outputs of the light barriers of measuring path 72. It is evident, in other words, that the measuring path 91 of FIGS. 5 and 6 is equivalent, as the output signals are concerned, to the measuring path 72 of FIGS. 1 and 2. For that reason for further explanation of the operation of the embodiment of FIGS. 5 to 7 it may be referred to the explanation for the embodiment in FIGS. 1 to 3.

In the embodiment of the invention shown in FIGS. 5 to 7 the general idea is to define the second measuring path by using an electrical equivalent, i.e. a so-called analogon, for the part concerned of the conveying path. In the case of FIGS. 5 to 7 a digitally operating analogon (simulation) is used, that is storage device 94 and pulse generator 93, since the first measuring path 72 is also operating on the base of digital output signals.

In case the conveying speed can be counted upon to be constant it will be dispensable to use a pulse generator which is synchronized to the conveying means. In case the first measuring path is designed in analog technique, as in FIG. 4, the second measuring path could make use of an analog time delay circuit.

It will be understood that the embodiments of FIGS. 1 and 5 could be modified so that not the trailing edge but the leading edge of an item passing the second measuring path is being used as reference edge, as is the case in FIG. 4, with the consequence, that successive items are delivered to the conveying means wth a predetermined distance B between their leading edges.

It will be understood that the above description of the present invention is susceptible to various modifications, changes and adaptations, and the same are intended to be comprehended within the meaning and range of equivalents of the appended claims.

What is claimed is:

1. In apparatus for the successive discharge and conveyance, along a conveying path, of separated items of mail from a stack of such items, which apparatus includes: means defining a stack region for containing such a stack of items and presenting a stack outlet for the discharge of items from one end of the stack; continuously driven conveying means spaced from the stack outlet and defining a portion of the conveying path, the conveying means having an effective range and conveying each item entering the effective range along such portion of the conveying path; removal means disposed between the stack region and the conveying means to define an initial portion of the conveying path and controllably operable for conveying successive items from the one end of the stack, through the stack outlet, along the initial portion of the conveying path and into the effective range of the conveying means, with a first edge of each item constituting a leading edge and a second edge of each item constituting a trailing edge; first item sensing means disposed for sensing the presence of an item of the conveying path at a location between the stack outlet and the conveying means; second item sensing means disposed for sensing the presence of an item on the conveying path at a location spaced from, and downstream of, the location associated with the first sensing means; and control means connected to respond to output signals from the sensing means and connected to control the operation of the removal means for causing the removal means to establish a desired spacing, along the conveying path, between one of the first and second edges of each item and the immediately following item which corresponds to the spacing between the first and second sensing means, the improvement wherein: each of said sensing means is arranged for monitoring an item along an associated measuring path along the conveying path, the measuring path of said first sensing means extending from said stack outlet and the measuring path of said second sensing means being offset from the measuring path of said first sensing means by a distance corresponding to the desired spacing; said first sensing means comprises means for producing an output signal representative of the distance which has been traversed by the leading edge of an item along the measuring path of said first sensing means; said second sensing means comprises means for producing an output signal representative of the distance which has been traversed by the one of the first and second edges of an item along the measuring path of said second sensing means; and said control means are arranged for responding to the output signals produced by said producing means for causing said removal means to begin conveying an item present on the initial portion of the conveying path upon production of output signals indicating that the distance traversed by the one of the edges of an item along the measuring path of said second sensing means is equal to the distance traversed by the leading edge of the immediately following item along the measuring path of said first sensing means.

2. An arrangement as defined in claim 1 further comprising third item sensing means disposed for sensing the presence of items in the region of the input end of the effective range of said conveying means and having means for producing an output signal connected to said control means.

3. An arrangement as defined in claim 1 wherein said control means are arranged for placing said removal means into operation to convey an item when no item is protruding into the first measuring path from the end thereof adjacent said stack outlet.

4. An arrangement as defined in claim 1 wherein each of said item sensing means comprises means defining a plurality of successive light barriers each having a signal output.

5. An arrangement as defined in claim 4 wherein said control means comprise means for logically linking the output signals from said light barriers of each said sensing means.

6. An arrangement as defined in claim 4 wherein said control means are arranged for comparing the number of said light barriers of said first sensing means presently being interrupted by an item with the number of said light barriers of said second sensing means presently being interrupted by an item.

7. An arrangement as defined in claim 4 further comprising third item sensing means disposed for sensing the presence of items in the region of the input end of the effective range of said conveying means and having means for producing an output signal connected to said control means.

8. An arrangement as defined in claim 4 wherein said control means are arranged for placing said removal means into operation to convey an item when no item is protruding into the first measuring path from the end thereof adjacent said stack outlet.

9. An arrangement as defined in claim 1 wherein each of said item sensing means comprises a sensing member for producing an output signal having an amplitude representative of the length of the measuring path of its respective sensing means presently occupied by an item.

10. An arrangement as defined in claim 9 further comprising third item sensing means disposed for sensing the presence of items in the region of the input end of the effective range of said conveying means and having means for producing an output signal connected to said control means.

11. An arrangement as defined in claim 9 wherein said control means are arranged for placing said removal means into operation to convey an item when no item is protruding into the first measuring path from the end thereof adjacent said stack outlet.

12. An arrangement as defined in claim 1 wherein said second sensing means comprise:

a. a sensing member arranged for monitoring the presence of items at the input end of the measuring path of said second sensing means; and b. means for electrically simulating, in dependancy on the output signal of said sensing member and on the conveying speed within the measuring path, the passage of an item trough the measuring path of said second measuring means.

13. An arrangement as defined in claim 12, wherein said simulating means comprise:

a. a pulse generator which is controlled by said continuously driven conveying means such as to emit a series of pulses the frequency of which is proportional to the conveying speed of items within said measuring path; and b. a storage device for simultating, in dependancy on the signals from said sensing member and on the pulses from said pulse generator, the passage of an item within the measuring path of said second sensing means.

14. An arrangement as defined in claim 12 wherein said storage device contains a shifting register the signal input of which is connected to said sensing member and the clock input of which is fed from the pulse generator, the parallel outputs of which being linked to said control means.

* * * * *